United States Patent [19]

Cyron

[11] Patent Number: 4,753,918

[45] Date of Patent: Jun. 28, 1988

[54] GROWTH COMPENSATING METALLIC EXHAUST GAS CATALYST CARRIER BODY AND METAL SHEET FOR MANUFACTURING THE SAME

[75] Inventor: Theodor Cyron, Bergisch Gladbach, Fed. Rep. of Germany

[73] Assignee: INTERATOM GmbH, Bergisch Gladbach, Fed. Rep. of Germany

[21] Appl. No.: 902,162

[22] Filed: Aug. 29, 1986

[30] Foreign Application Priority Data

Aug. 29, 1985 [DE] Fed. Rep. of Germany ..... 3530893

[51] Int. Cl.[4] ..... B01J 32/00; B01J 35/04

[52] U.S. Cl. ..... 502/439; 502/527; 428/596

[58] Field of Search ..... 502/439, 527; 428/596

[56] References Cited

U.S. PATENT DOCUMENTS

| | | | |
|---|---|---|---|
| 3,544,706 | 12/1970 | Aupoix | 428/596 X |
| 4,006,105 | 2/1977 | Fedor et al. | 502/527 X |
| 4,273,681 | 6/1981 | Nonnenmann | 502/527 X |

FOREIGN PATENT DOCUMENTS

| | | |
|---|---|---|
| 1192624 | 1/1966 | Fed. Rep. of Germany . |
| 2226662 | 12/1972 | Fed. Rep. of Germany . |
| 2302746 | 7/1974 | Fed. Rep. of Germany . |
| 2403024 | 8/1974 | Fed. Rep. of Germany . |
| 2140110 | 1/1973 | France . |
| 2447462 | 8/1980 | France . |
| 2001547 | 2/1979 | United Kingdom . |

*Primary Examiner*—W. J. Shine

*Attorney, Agent, or Firm*—Herbert L. Lerner; Laurence A. Greenberg

[57] ABSTRACT

Metallic exhaust gas catalyst carrier body, includes high temperature-resistant steel sheets forming a multiplicity of cells permeable to exhaust gas in a given exhaust gas direction, the steel sheets having slits formed therein substantially transverse to the given exhaust gas direction, the slits, in unused state of the carrier body, being of such quantity and size that for every cross section of each of the steel sheets in the given exhaust gas direction substantially between 5% and 30% of the cross section is devoid of steel due to the presence of the slits.

16 Claims, 2 Drawing Sheets

GROWTH COMPENSATING METALLIC EXHAUST GAS CATALYST CARRIER BODY AND METAL SHEET FOR MANUFACTURING THE SAME

The invention relates to a metallic exhaust or waste gas catalyst carrier body being layered or wound from high temperature resistant steel sheets, preferably containing aluminum, with a multiplicity of exhaust gas permeable cells, and to a steel sheet for the production thereof.

In principle, the construction of catalyst carrier bodies made of smooth and corrugated metal sheets is known, for instance, from German Pat. No. DE-PS 11 92 624. The use of such catalyst carrier bodies made of steel sheets for automobile exhaust gases is known from German Published Non-Prosecuted application DE-OS No. 23 02 746 as well as from several further developments. For example, German Published Non-Prosecuted application DE-OS No. 24 03 024 shows that such carrier bodies can also be made from sheet-metal strips. Furthermore, catalyst carrier bodies made of slotted or otherwise formed metal sheets are known, wherein the turbulence of the exhaust gases is enhanced.

Additionally, German Published Non-Prosecuted application DE-OS No. 22 26 662 discloses the use of metal mesh or expanded metal instead of conventional steel sheets in catalyst carrier bodies. However, the forms of the metal sheets used heretofore were only chosen with respect to adherence to requirements of the coating which is applied later and with respect to their gas conducting properties.

However, experience has shown that an additional property of the metallic waste gas catalyst carrier bodies must be considered in constructing the metal sheets of which they are constructed. During operation at very high temperatures over a long period of time, the conventionally used steel sheets containing aluminum grow to about 20% beyond their original dimensions. This does not refer to a thermal expansion, but to actual growth, which remains even after the body has cooled. If this growth is obstructed by a close-fitting connection with a thick tubular shell, considerable stresses are generated which can destroy the whole catalyst carrier body. The high mechanical loads to which an exhaust gas catalyst carrier body is subjected, especially in motor vehicles, on the other hand, require that the body be fastened as firmly as possible in a tubular shell.

It is accordingly an object of the invention to provide a growth compensating metallic exhaust gas catalyst carrier body and metal sheet for manufacturing the same, which overcomes the hereinafore-mentioned disadvantages of the heretofore-known devices of this general type, and which can compensate, in the interior thereof, for growth which occurs during operation, while its outer dimensions, especially its length in the exhaust gas flow direction, remain unchanged.

With the foregoing and other objects in view there is provided, in accordance with the invention, a metallic exhaust or waste gas catalyst carrier body, comprising high temperature resistant wound or layered steel sheets, which may be, for example, alternatingly smooth and corrugated or have another structure, preferably containing aluminum forming a multiplicity of cells similar to a honeycomb permeable to exhaust gas in given exhaust gas direction, the steel sheets having slits or openings formed therein substantially transverse, across or at right angles to the given exhaust gas direction, the slits having, in unused state of the carrier body, such a quantity and size that for any cross section through every one of the steel sheets in the given exhaust gas direction substantially between 5 and 30% of the cross-sectional area is devoid of steel due to the presence of the slits.

Due to the presence of the openings transverse to the direction of the exhaust gas flow, longitudinal expansions of the catalyst carrier body can grow or develop into the slits, so that the overall length of the catalyst carrier body does not change. For this purpose, the quantity and size of the slits in a fresh unused carrier body must be dimensioned in such a way that the expected growth during its lifetime can be absorbed by the slits. Therefore, depending on the life expectancy, 5, 10, 20 or up to 30% of the length of the catalyst carrier body should be devoid of steel i.e. vacant, due to the presence of the slits.

In accordance with another feature of the invention, the slits have the shape of greatly elongated diamonds or lozenges, are mutually offset and are mutually spaced apart at regular distances substantially transverse to the given exhaust gas direction. Such a metal sheet is similar to a metal mesh or expanded metal shortly after the stretching has started, except that in this case, the openings run in the longitudinal direction of the metal strip and not in the transverse direction, as is the case with metal mesh or expanded metal.

In accordance with a further feature of the invention, the slits have a length to width ratio of substantially 5:1 and preferably 10:1.

In accordance with an added feature of the invention, the slits are spaced apart in the exhaust gas direction and transverse to the exhaust gas direction by a distance equal to at least three or preferably five time the width of the slits. These dimensions allow for sufficient growth, but do not diminish the stability of the catalyst carrier body.

In accordance with an additional feature of the invention, there is provided a tubular shell solidly structurally connected to the carrier body at both ends and preferably at other locations along the periphery thereof. This is one of the essential advantages of the invention which assures that growth has no detrimental effects on the stability of the connections in the structure.

In accordance with again another feature of the invention, the carrier body has a non-circular cross section. Although other possibilities for compensating for growth can be provided for cylindrical exhaust gas catalyst carrier bodies, this becomes more difficult with catalyst carrier bodies whose cross sections are non-circular. In this case the invention provides a solution permitting growth compensating catalyst carrier bodies with any kind of cross section to be produced.

With the objects of the invention in view there is also provided a steel sheet for producing an exhaust or waste gas catalyst carrier body wound or layered from alternatingly smooth and corrugated or otherwise structured sheetmetal strips forming a multiplicity of cells permeable to exhaust gas in a given exhaust gas direction, the steel sheet having slits or openings formed therein substantially transverse to the exhaust gas direction; the slits being mutually spaced apart at regular distances and mutually offset.

In accordance with a concomitant feature of the invention, the slits are in the shape of greatly elongated diamonds or lozenges.

Other features which are considered as characteristic for the invention are set forth in the appended claims.

Although the invention is illustrated and described herein as embodied in growth compensating metallic exhaust gas catalyst carrier body and metal sheets for manufacturing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

BRIEF DESCRIPTION OF THE DRAWINGS

Referring now to FIGS. 1 and 2 of the drawings in detail, there is seen a steel sheetmetal strip 1 provided with a multiplicity of diamond-shaped or rhomboid slits or openings 2, which are disposed at regular distances b from each other, in such a way that an imaginary line interconnecting center points of the openings also forms a rhomboid or diamond-shaped pattern. The width a of the material between the individual slits or openings 2 is about half of the distance b between the openings 2 that are adjacent or on top of each other. The width d of the diamond-shaped slits or openings 2 is much smaller than the length c of the slits or openings 2. The ratio c:d should be at least 5:1 and preferably greater than 10:1. The absolute value for the width d of the openings can lie between 1 mm and 5 mm, for example. The openings can be produced in different ways, such as by stamping, etching, or the like. A galvanoplastic, metalloplastic or electroplating method for the production of the steel strips is also made possible wherein the slits or openings 2 remain directly free of metal. The slits or openings 2 can also be produced by longitudinal slots which are expanded. The slits or openings 2 which serve for compensating growth can also be dimensioned in such a way that they are not completely closed even after maximum growth. In this case they contribute to an increased turbulence of the exhaust gases during the entire life of the catalyst carrier body and thus increase the effectiveness of the catalyst system. The invention is especially suited for metallic catalyst carrier bodies which are intended to be used close to the outlet of a combustion engine.

FIG. 3 shows a catalyst carrier body 34 which is nearly completely wound. It is formed of helically or spirally wound layers of smooth or planar steel sheetmetal strips 31*a* alternating with wavy or corrugated steel sheetmetal strips 31*b* which are both formed with diamond or lozenge-shaped slits 32 such as the slits 2 of FIGS. 1 and 2. The wound-up sheetmetal strips 31*a* and 31*b* form a multiplicity of cells 33 through which exhaust gas can flow as indicated by the arrow 35. In a cross section taken along the line 36*a* or 36*b*, for example, through the sheetmetal strips 31*a* and 31*b*, part of the resulting cross-sectional area is free or devoid of steel due to the presence of the slits 32, the empty spaces thus formed in the sheetmetal being able to become entirely or partly filled or closed by subsequent growth or expansion of the material of the catalyst carrier body.

In FIG. 4, a completely finished catalyst carrier body 34 enclosed in a casing tube or tubular 37 is shown in an end view.

Figure 1:
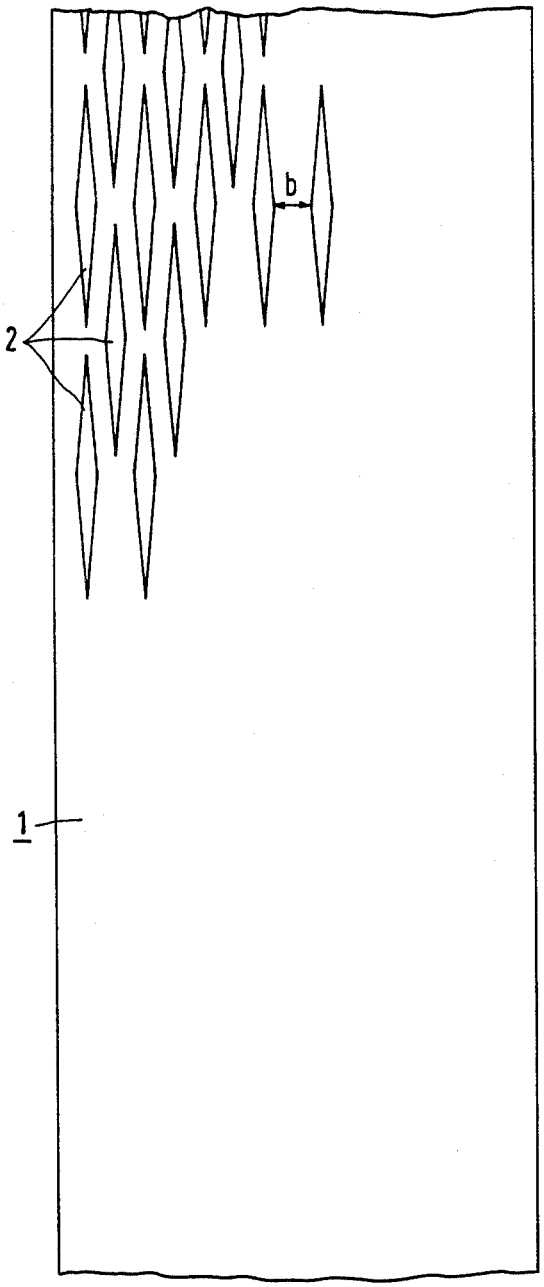
FIG. 1 is a top plan view of a steel sheetmetal strip according to the invention.
Figure 2:
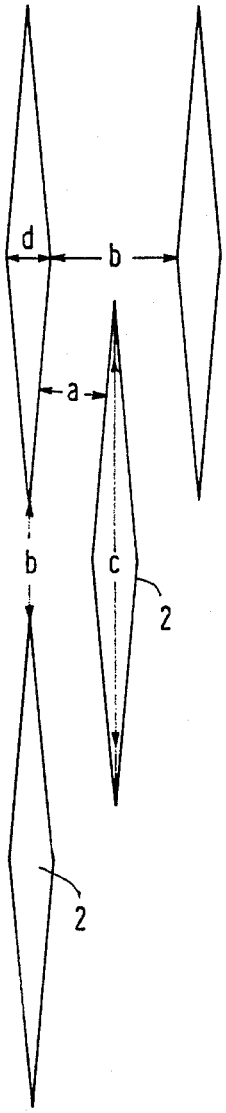
FIG. 2 is an enlarged view of a portion of FIG. 1, illustrating the dimensions of the openings.
Figure 3:
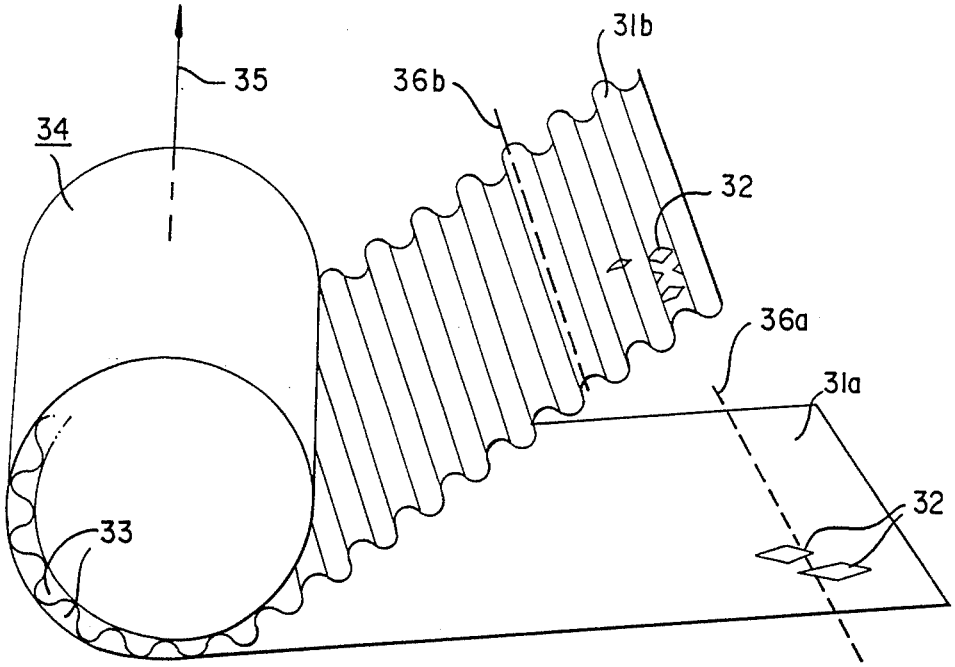
FIG. 3 is a diagrammatic perspective view of an almost completely wound catalyst carrier body embodying the sheetmetal strip of FIGS. 1 and 2.
Figure 4:
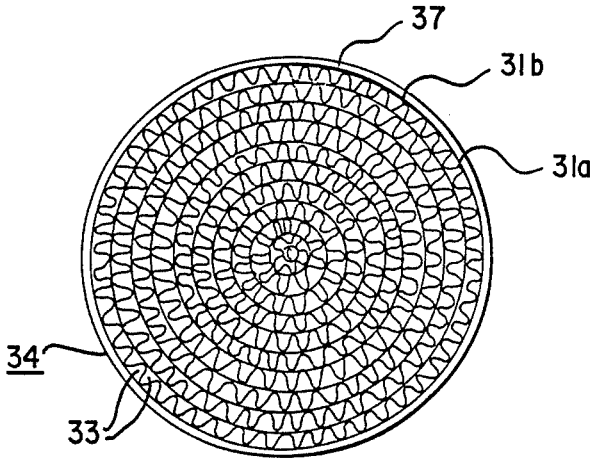
FIG. 4 is an end view of a completed catalyst carrier body enclosed in a casing tube or tubular shell.

I claim:

1. Metallic exhaust gas catalyst carrier body, comprising high temperature-resistant steel sheets containing aluminum forming a multiplicity of cells permeable to exhaust gas in a given exhaust gas direction, said steel sheets having slits formed therein substantially transverse to said given exhaust gas direction, said slits, in unused state of the carrier body, having a length to width ratio of at least substantially 5:1 and being of such quantity and size that for every cross section of each of the steel sheets in said given exhaust gas direction substantially between 5% and 30% of the cross-sectional area is devoid of steel due to the presence of said slits.

2. Exhaust gas catalyst carrier body according to claim 1, wherein substantially between 10% and 20% of said cross section in devoid of steel due to the presence of said slits.

3. Exhaust gas catalyst carrier body according to claim 1, wherein said steel sheets are wound on top of each other.

4. Exhaust carrier body according to claim 1, wherein said steel sheets are layered on top of each other.

5. Exhaust gas catalyst carrier body according to claim 1, wherein said slits have the shape of elongated diamonds, are mutually offset and are mutally spaced apart at regular distances substantially transverse to said given exhaust gas direction.

6. Exhaust gas catalyst carrier body according to claim 1, wherein said slits have a length to width ratio of substantially 10:1.

7. Exhaust gas catalyst carrier body according to claim 1, wherein said slits are spaced apart in said exhaust gas direction and transverse to said exhaust gas direction by a distance equal to at least three times the width of said slits.

8. Exhaust gas catalyst carrier body according to claim 1, wherein said slits are spaced apart in said exhaust gas direction and transverse to said exhaust gas direction by a distance equal to at least five times the width of said slits.

9. Exhaust gas catalyst carrier body according to claim 1, including a tubular shell solidly structurally connected at both ends thereof to said steel sheets.

10. Exhaust gas catalyst carrier body according to claim 1, including a tubular shell solidly structurally connected to said steel sheets at both ends and at other locations along the periphery thereof.

11. Exhaust gas catalyst carrier body according to claim 1, wherein said steel sheets have a non-circular cross section.

12. Steel sheet containing aluminum for producing an exhaust gas catalyst carrier body formed of sheetmetal strips defining therebetween a multiplicity of cells permeable to exhaust gas in a given exhaust gas direction, the steel sheet having slits formed therein having a length to width ratio of at least substantially 5:1 and extending substantially transversely to said exhaust gas direction, said slits being mutually spaced apart at regular distances and mutually offset.

13. Steel sheet according to claim 12, wherein said slits are in the shape of elongated diamonds.

14. Steel sheet according to claim 12, wherein said slits have a length to width ratio of substantially 10:1.

15. Steel sheet according to claim 12, wherein said slits are spaced apart in said exhaust gas direction and traverse to said exhaust gas direction by a distance equal to at least three times the width of said slits.

16. Steel sheet according to claim 12, wherein said slits are spaced apart in said exhaust gas direction and transverse to said exhaust gas direction by a distance equal to at least five times the width of said slits.

* * * * *